United States Patent [19]

Helmso et al.

[11] 4,106,677

[45] Aug. 15, 1978

[54] WRIST WEARABLE ELECTRONIC DEVICE WITH AN ENGAGEDLY STORED SELECTED TOOL

[75] Inventors: Bennie E. Helmso, Los Altos; Thomas E. Holden, Scotts Valley, both of Calif.; Edward T. Liljenwall, Corvallis, Oreg.

[73] Assignee: Hewlett-Packard Company, Palo Alto, Calif.

[21] Appl. No.: 715,805

[22] Filed: Aug. 19, 1976

[51] Int. Cl.[2] ..... A44C 5/02

[52] U.S. Cl. ..... 224/5 A; 58/23 BA; 63/1 R; 224/4 E; 224/28 B

[58] Field of Search ..... 224/4 A, 4 B, 4 D, 4 E, 224/4 F, 4 H, 5 A, 5 B, 5 H, 26 B, 28 R, 28 B, 28 W, 4 J; 58/23 BA, 88 R; 63/1 R, 1 A, 2, 3, 21; 24/265 WS

[56] References Cited

U.S. PATENT DOCUMENTS

| | | | |
|---|---|---|---|
| 2,065,657 | 12/1936 | Coleman | 224/4 B X |
| 2,229,134 | 1/1941 | Sauer | 224/4 D |
| 3,565,304 | 2/1971 | Kalinsky | 224/4 E |
| 3,670,491 | 6/1972 | Weschler | 58/23 BA |
| 3,729,923 | 5/1973 | Brigliano | 58/23 BA X |
| 3,780,918 | 12/1973 | Curtis | 224/28 B X |
| 3,965,670 | 6/1976 | Ihringer | 224/4 E X |
| 3,975,899 | 8/1976 | Haber | 58/88 R |

FOREIGN PATENT DOCUMENTS

| | | | |
|---|---|---|---|
| 1,075,505 | 2/1960 | Fed. Rep. of Germany | 58/23 BA |
| 557,502 | 5/1958 | United Kingdom | 63/1 R |

*Primary Examiner*—Trygve M. Blix
*Assistant Examiner*—Winston H. Douglas
*Attorney, Agent, or Firm*—Allston L. Jones

[57] ABSTRACT

Wrist wearable straps and a case are disclosed, each having an interior cavity for engagedly storing a special tool. One wrist device strap is made of a selected material and defines a pocket for holding the special tool. A second wrist device strap includes at least one special link defining an interior cavity for holding the special tool. These special links also include a removable portion to which is attached a special tool. The removable portion blends with the remainder of the link to give the appearance of a regular link when in place. The wrist device case similarly defines a cavity and includes a removable portion to which is attached a special tool. This removable portion enhances the appearance of the case when in place with the special tool held snugly within the cavity.

2 Claims, 9 Drawing Figures

WRIST WEARABLE ELECTRONIC DEVICE WITH AN ENGAGEDLY STORED SELECTED TOOL

BACKGROUND AND SUMMARY OF THE INVENTION

A typical wrist-worn device requiring the use of a special tool for a particular function is one type of electronic watch. This watch requires the use of a small permanent magnet to set the correct time when the battery is changed. The watch and the magnet are supplied separately, which often results in loss or misplacement of the magnet.

Another model of a similar electronic watch is supplied with a stainless steel band having a closable compartment in the clasp. The magnet for setting the time is loosely stored in this closed compartment when not in use.

In accordance with the illustrated embodiments, the present invention provides a wrist-wearable item having a cavity for engagedly storing a special tool. A first embodiment includes a wrist strap of a selected material. A second embodiment includes a wrist strap having a plurality of regular links and at least one special link. Each special link has a body and a removable portion. The special link body defines a cavity in which the special tool is stored. The removable link portion, to which is attached the special tool, blends with the link body to give the appearance of a regular link when the special tool is fully inserted into the cavity within the special link.

The third embodiment includes a wrist device case with a first case portion that defines a cavity adjacent to a cut-out region. A second case portion fits into the cut-out region of the first case portion and has the special tool attached thereto. When the special tool is fully inserted into the cavity, the second case portion blends with the first case portion to complete the wrist device case and to give a smooth appearance to the general outline of the complete case.

In the second and third embodiments, a spring captured within the cavity biases the tip of the special tool between itself and the interior of the cavity, thus holding the special tool and the removable link or second case portion in position.

DESCRIPTION OF THE PREFERRED EMBODIMENT

Figure 1A:
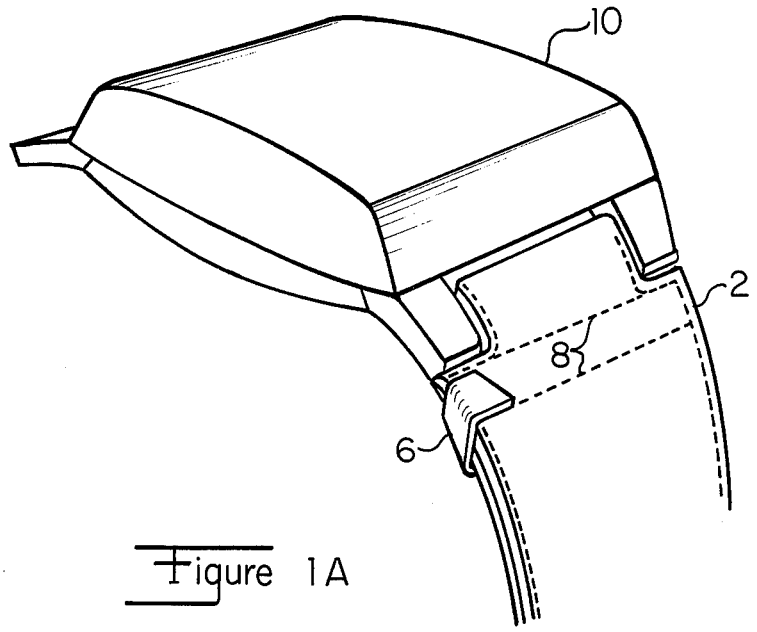
FIGS. 1*a* and 1*b* are perspective representations of a wrist device with one embodiment of a wrist band of the present invention attached thereto.
Figure 1B:
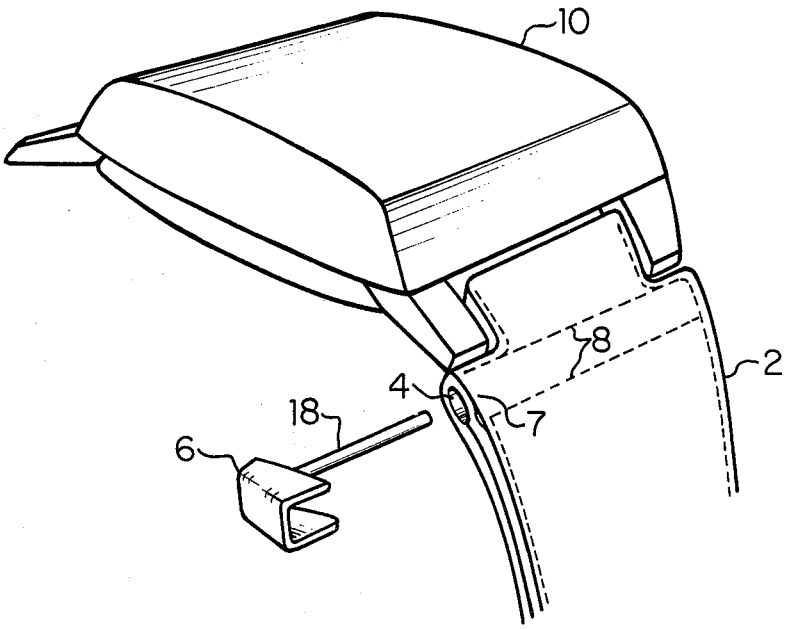

FIGS. 1*a* and 1*b* show a first embodiment of the present invention. These figures show a wrist device 10 to which a first style wrist strap 2 is attached by a conventional technique. Wrist strap 2 includes at least one pocket 4 opening to one side thereof for holding special tools 18. Each of tools 18 is designed for performing selected operations on wrist device 10 and has a clip 6 attached thereto for grasping tool 18 for removal from pocket 4. Wrist strap 2, in its simplest form, is made from a single piece of material, e.g., leather or vinyl, that is folded in half and stitched around the edges. Pocket 4 is formed in wrist strap 2 by leaving a gap in the edge stitching at 7 where pocket 4 is to be located. To complete pocket 4, stitching 8 is added across wrist strap 2 to create a snug friction fit of the interior of pocket 4 with tool 18 when it is inserted therein.

Figure 2A:
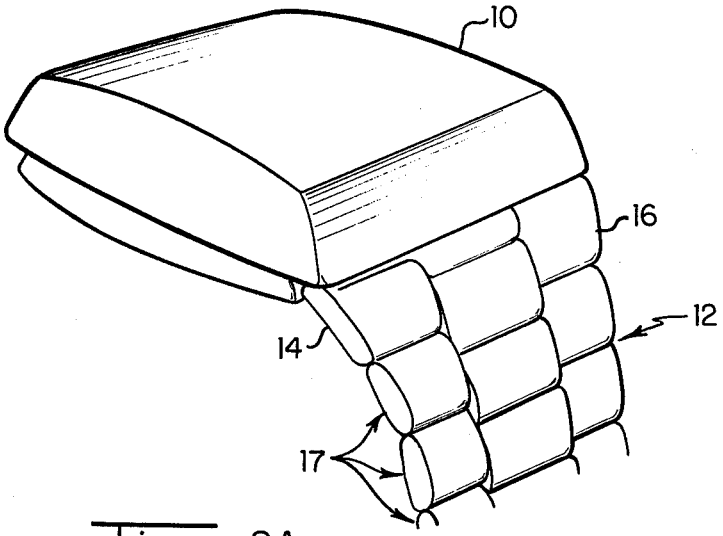
FIGS. 2*a* and 2*b* are perspective representations of a wrist device with a second embodiment of a wrist band of the present invention attached thereto.
Figure 2B:
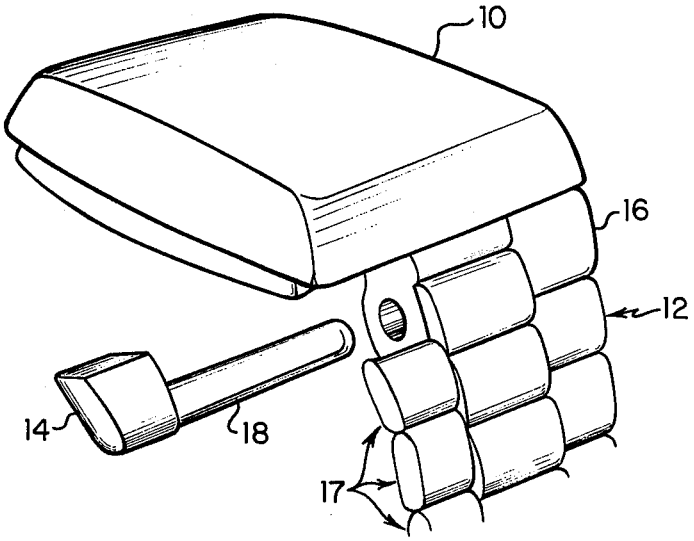

With reference to FIGS. 2*a* and 2*b*, there is shown a second embodiment of the present invention. These figures show a wrist device 10 and second style wrist strap 12 attached thereto. Wrist strap 12 includes one or more special links 16 and a plurality of complete links 17. Each of the special links 16 has a securely held removable portion 14 having a special tool 18 attached thereto.

Tool 18 can be any special application tool required for selected operations on or with wrist device 10. For example, if wrist device 10 is an electronic wrist calculator, tool 18 could be a stylus for depressing the necessarily small and close together keys of the electronic wrist calculator. In any application where such a tool is necessary, the incorporation of tool 18 into wrist strap 2 or 12 greatly reduces the chance of misplacing the tool and makes the tool readily accessible to the user.

Figure 3:
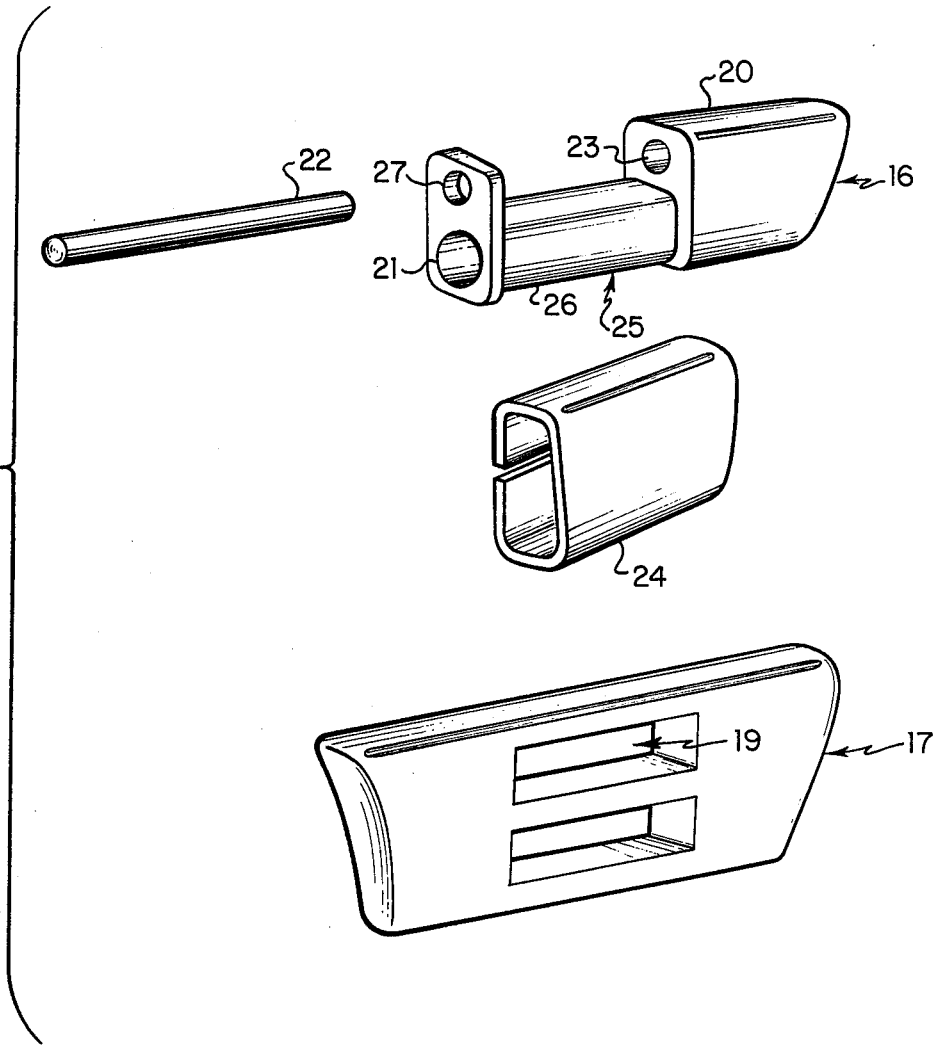
FIG. 3 is a perspective representation of the composite parts of a special link and an adjacent link of the second embodiment wrist band into which a special tool is stored.

FIG. 3 shows special link 16 and an adjacent complete link 17 separate from wrist strap 12. Special link 16 includes a body 20, a push pin 22, and a clip 24. Additionally, body 20 defines a first cavity 21 for receiving tool 18, and a second cavity 23 for receiving push pin 22. Special link 16 is connected to adjacent complete links 17 of wrist strap 12 by means of push pin 22 or clip 24. To connect special link 16 to the next lower adjacent complete link 17, clip 24 is formed around portion 25 of body 20 and through cut-out 19 of complete link 17. Special link 16 is connected to the next upper adjacent complete link 17 in wrist strap 12 or to the case of wrist device 10 by means of push pin 22. This is accomplished by slipping push pin 22 through hold 27 in the leftmost end of body 20 and then slipping it through a clip similar to 24 that is attached to the next adjacent upper complete link 17 of wrist strap 12 or to the case of wrist device 10. Push pin 22 extends through the clip attached to the next upper link 17 and into cavity 23 formed within body 20 of special link 16. Adjacent complete links 17 are interconnected by forming a clip 24 through cut-out 19 of both of these links.

Figure 4A:
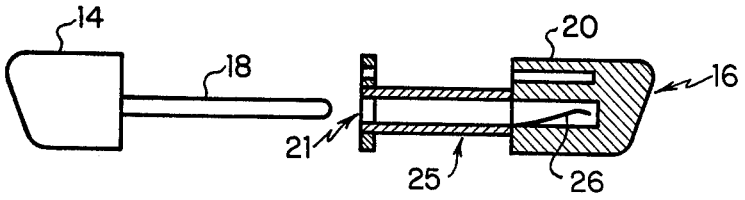
FIGS. 4*a* and 4*b* are cross-sectional views of the special link for storing the special tool as shown in FIG. 3 with the special tool removed and inserted, respectively.
Figure 4B:
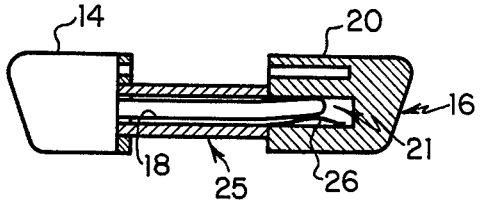

FIGS. 4*a* and 4*b* illustrate how tool 18 is securely held within body 20 of special link 16 of this embodiment. In these figures a spring 26 is shown within cavity 21 of body 20. FIG. 4*b* shows tool 18 fully inserted within cavity 21 of body 20 and securely held by spring 26 biasing the tip of tool 18 between the interior of cavity 21 and itself to provide a snug fit.

Figure 5A:
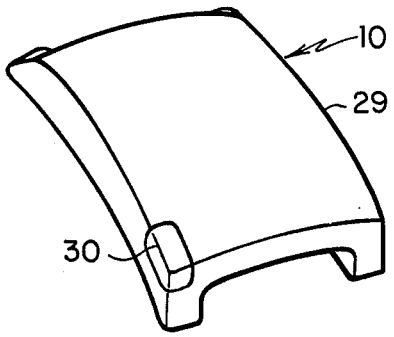
FIGS. 5*a* and 5*b* are perspective representations of a third embodiment of the invention wherein the special tool is stored within a portion of the wrist device case.
Figure 5B:
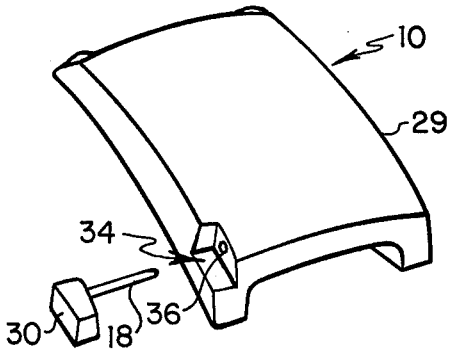

FIGS. 5*a* and 5*b* illustrate a third embodiment of the present invention wherein it is shown that wrist device 10 includes a first case portion 29 and a second case portion 30. FIG. 5*b* shows second case portion 30 removed from first case portion 29. This figure further shows a special tool 18 attached to second case portion 30. In addition, first case portion 29 defines a cut-out region 34 and a cavity 36. Cavity 36 is shaped to receive tool 18 and cut-out region 34 is shaped to accommodate second case portion 30. When tool 18 is fully inserted into cavity 36, second case portion 30 fits into cut-out 34 and blends into the overall outline of first case portion 29. Tool 18 and second case portion 30 are securely held in place in a manner similar to that described in relation to FIGS. 4*a* and 4*b*.

We claim:

1. A wrist-wearable electronic device with provision for storing a special application tool therein, comprising:

a case portion; and a wrist strap portion connected to said case portion to encircle the wrist of a wearer, said wrist strap portion including:

a selected number of complete links; and at least one special link having:

a body portion connectable, independent of the special application tool, to at least one other link of either type adjacent thereto, said body portion defining a cavity and;

the special application tool being removable for performing selected operations upon one of said case and wrist strap portions, a portion of the special application tool being storable within the cavity of said body portion, and when the special application tool is so stored, another portion of the special application tool blends with the body portion to complete the external appearance of the special link so that it resembles a complete link.

2. A wrist-wearable electronic device as in claim 1 wherein said special link further includes attachment means coupled to said body portion for engagedly storing said special application tool within the cavity defined by said body portion.

* * * * *